United States Patent [19]

MacGregor

[11] Patent Number: 5,067,340

[45] Date of Patent: Nov. 26, 1991

[54] PRECISION PRESS BRAKE

[76] Inventor: Donald C. MacGregor, 13 Hunters Trail, Warren, N.J. 07060

[21] Appl. No.: 345,675

[22] Filed: May 3, 1989

Related U.S. Application Data

[63] Continuation-in-part of Ser. No. 190,632, May 5, 1988, abandoned.

[51] Int. Cl.[5] ..... B21D 5/01

[52] U.S. Cl. ..... 72/389; 72/446; 72/453.08; 72/481; 100/258 A

[58] Field of Search ..... 72/389, 448, 446, 481, 72/477, 453.08, 465, 482; 100/258 A

[56] References Cited

U.S. PATENT DOCUMENTS

| | | | |
|---|---|---|---|
| 1,975,249 | 10/1934 | Bradley et al. . | |
| 3,550,425 | 12/1970 | Cailloux | 72/386 |
| 3,668,919 | 6/1972 | Hongo | 72/324 |
| 3,682,465 | 8/1972 | Hanni et al. | 267/130 |
| 3,829,074 | 8/1974 | Hanni et al. | 267/130 |
| 3,844,156 | 10/1974 | Hanni et al. | 72/389 |
| 3,914,975 | 10/1975 | Kawano | 72/389 |
| 4,014,204 | 3/1977 | Hanni et al. | 72/465 |
| 4,016,742 | 4/1977 | Shiokawa . | |
| 4,063,445 | 12/1977 | Haenni . | |
| 4,106,323 | 8/1978 | Haenni et al. | 72/389 |
| 4,347,727 | 9/1982 | Galiger | 72/389 |
| 4,366,698 | 1/1983 | Gill | 72/389 |
| 4,486,841 | 12/1984 | Koyama et al. | 72/21 |
| 4,498,328 | 2/1985 | Nagakura | 72/389 |
| 4,534,203 | 8/1985 | Cros . | |
| 4,608,852 | 9/1986 | Kogure et al. | 72/389 |
| 4,620,435 | 11/1986 | Gabella et al. | 72/389 |
| 4,640,113 | 2/1987 | Dieperink et al. | 72/21 |
| 4,653,307 | 3/1987 | Zbornik | 72/389 |
| 4,660,402 | 4/1987 | Hongo | 72/389 |

FOREIGN PATENT DOCUMENTS

| | | | |
|---|---|---|---|
| 0119108 | 9/1974 | European Pat. Off. . | |
| 0256245 | 2/1988 | European Pat. Off. . | |
| 3235775 | 3/1984 | Fed. Rep. of Germany . | |
| 3245755 | 6/1984 | Fed. Rep. of Germany . | |
| 2200064 | 4/1974 | France . | |
| 2346067 | 10/1977 | France . | |
| 79/044 | 10/1979 | PCT Int'l Appl. | 72/389 |
| 1399308 | 7/1975 | United Kingdom . | |
| 1474819 | 5/1977 | United Kingdom . | |
| 82/02360 | 7/1982 | World Int. Prop. O. . | |

*Primary Examiner*—David Jones

*Attorney, Agent, or Firm*—Arnold, White & Durkee

[57] ABSTRACT

A bending press comprising a lower frame member, an upper frame member mounted above the lower frame member, tool holding means positioned in operative association with one of the frame members for holding bending tool means, die holding means positioned in operative association with the other of the frame members for holding die means, a plurality of first hydraulic rams mounted in laterally spaced relationship to be operative between the tool holding means and the associated frame member, a plurality of second hydraulic rams mounted in laterally spaced relationship to be operative between the die holding means and the associated frame member, the first hydraulic rams being adapted to be hydraulically connected together during use for hydraulic fluid to distribute a load applied to a workpiece during use evenly between the first hydraulic rams and provide compensation for frame member deflection during use, and the second hydraulic rams being adapted to be hydraulically connected together during use for hydraulic fluid to distribute a load applied to a workpiece during use evenly between the second hydraulic rams and provide compensation from frame member deflection during use.

17 Claims, 11 Drawing Sheets

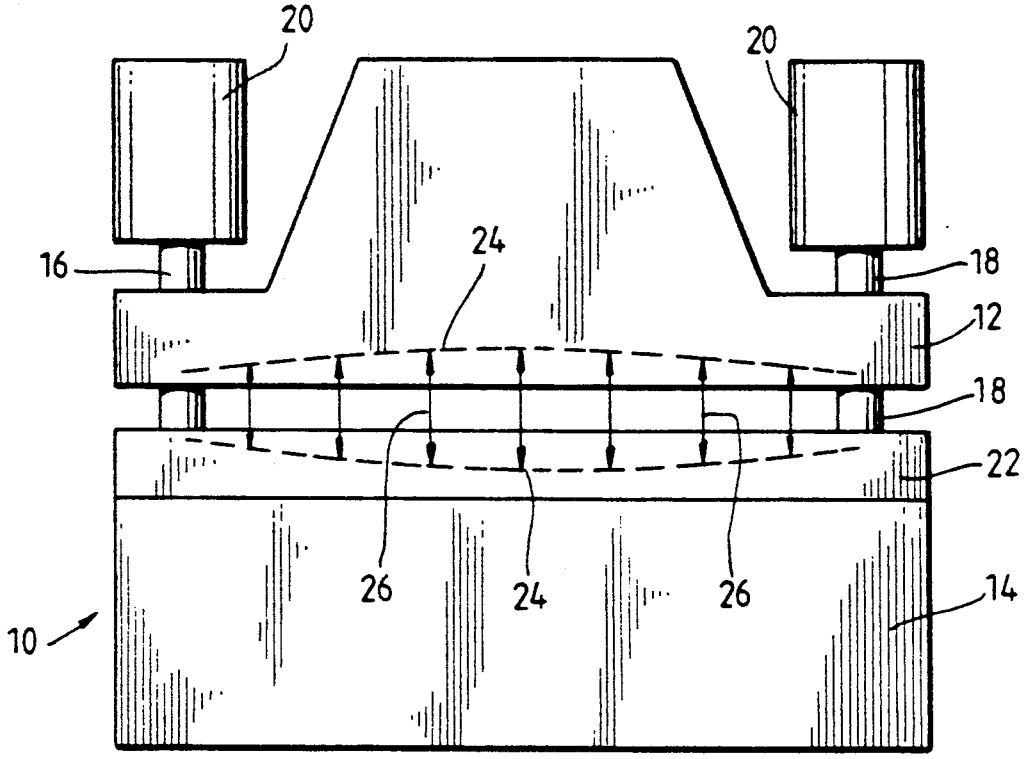
FIG.1
(PRIOR ART)
FIG.2
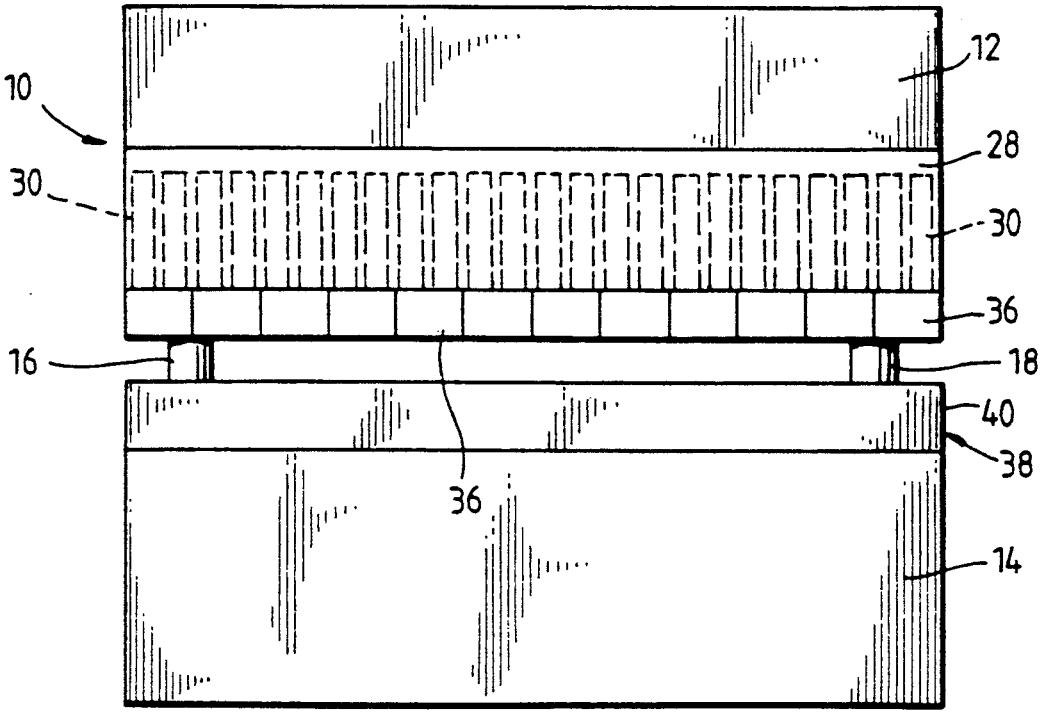

FIG.10
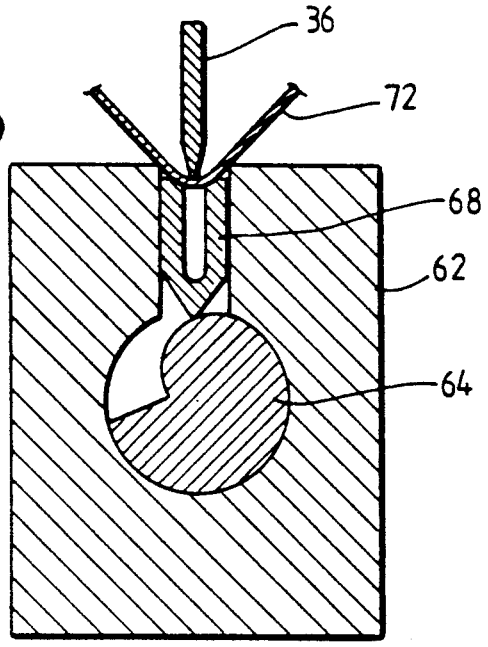
FIG.11
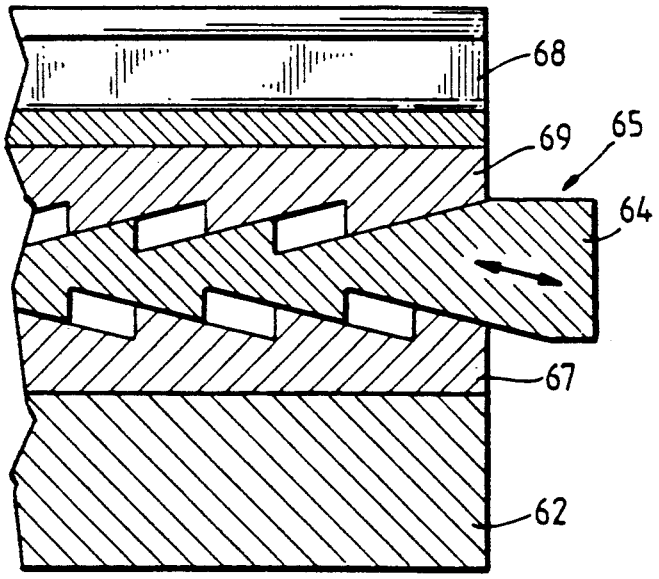
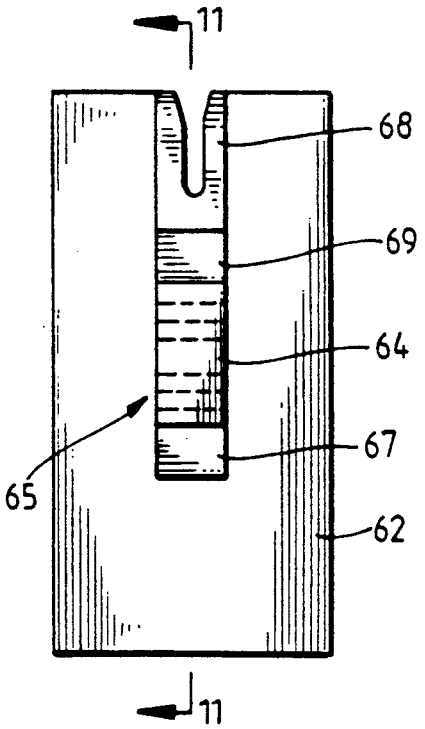
FIG.12

PRECISION PRESS BRAKE

This application is continuation-in-part application of my prior co-pending application Ser. No. 190,632 filed May 5, 988, now abandoned.

BACKGROUND OF THE INVENTION

1. Field of the Invention

The present invention relates to bending presses such as press brakes for bending sheet-like wor)qpieces such as sheet metals. More particularly this invention relates to hydraulic bending presses in which the bending tools are operated by hydraulic means.

2. Description of the Prior Art

The closing forces from a press brake endpoints create bed and ram deflection resulting in uneven longitudinal bending forces. The inherent problem of bed and ram deflection (as illustrated in exaggerated form in prior art FIG. 1), occurring as a result of the bending load, creates a variation of the bend angle along the length of the bend of the workpiece. The result is larger clearances and therefore lighter workloading toward the center of the workpiece, with heavier loading at the bending line workpiece edges. The resulting workpieces are thus bent to greater angles toward the edges resulting in longitudinal curvature of the finished workpieces.

SUMMARY OF THE INVENTION

It is an object of the invention to provide a bending press in which the workload is applied to the workpiece by a relatively even and uniform workloading means during the bending of the workpiece.

It is another object to provide easy adjustment control of the bend angle. In embodiments of the invention this can be achieved by cam action which can be manual or powered and programmable.

It is further an object to provide centering control of the workpiece in the die by using a split bottom die to prevent or reduce angle bending error due to deviations in the longitudinal alignment of the tool and die.

It is additionally an object to permit hemming the workpiece with the tool and die workpiece bending members within the plane of the bending operations.

It is therefore a further object of the present invention to provide a precision press brake which can increase bending angle accuracy by eliminating or reducing longitudinal bend error to provide more consistent full length bend accuracy.

In accordance with one aspect of the invention, there is provided a bending press or press brake comprising:

(a) a lower frame member;

(b) an upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use; and (h) the second hydraulic rams being adapted to be hydraulically connected together during use for hydraulic fluid to distribute a load applied to a workpiece during use evenly between the second hydraulic rams and provide compensation for frame member deflection during use.

The bending press of this embodiment preferably includes a set of first hydraulic conduits connecting the first hydraulic rams together, and a set of second hydraulic conduits connecting the second hydraulic rams together. In a most preferred embodiment of this aspect of the invention the sets of first and second hydraulic conduits are connected together for hydraulic fluid during use to evenly distribute a load applied to a workpiece between the first and second hydraulic rams to provide shielding for a workpiece against the effects of frame member deflection during use.

In accordance with this aspect of the invention, in use, the forces applied to a workpiece will tend to be relatively equal and uniform along the workpiece thereby limiting the distortion or deflection during bending of the workpiece. The deflection forces exist largely in the upper and lower frames, and in frame sections, such as C-frames, which connect the upper and lower frames, but are largely isolated from the bending tool means and die means and thus from the workpiece, as the deflection forces tend to be balanced above and below the workpiece by the pairs of first and second hydraulic rams or cylinders.

The first and second hydraulic rams are preferably evenly spaced along the lengths of their associated frame members.

The first and second hydraulic rams are preferably arranged in vertically aligned pairs. Further, the bending press may include deactivation means for selectively deactivating one or more of the hydraulic rams.

Such deactivation is preferably arranged to deactivate selected pairs of first and second hydraulic rams. In this way, where a workpiece which is shorter than the length of the bending press is to be pressed, the first and second hydraulic ram pairs which overhang the extremities of the workpiece, may be deactivated.

In a similar application, if two different workpieces are to be operated upon simultaneously, they can be positioned in appropriately spaced intervals within the bending press, and the first and second pairs of hydraulic rams which overhang the workpieces, can be deactivated before the pressing operation is commenced.

The deactivation means may be mechanical deactivation means which can be mechanically applied to the hydraulic rams to deactivate them. Alternatively, for example, the deactivation means may comprise any suitable valve means in the hydraulic conduits, which can be activated to isolate hydraulic rams from the hydraulic fluid pressure during use. The valve means may be of any conventional type. It may conveniently, for example, be in the form of solenoid operated valve means.

The first and second hydraulic rams may preferably be arranged in closely spaced lateral relationship along the lengths of their associated frame members.

The upper and lower frame members may be mounted in position in a rigid structure by any appropriate means. They may conveniently be mounted in position by being mounted to a pair of laterally spaced C-frames.

The bending press of this invention may include a pair of vertically extending guide posts which are mounted in laterally spaced relationship rearwardly spaced relatively to the upper and lower frame members, and may include a pair of upper and a pair of lower support arms which have inner ends and outer ends, with the inner ends being slidably mounted on the guide posts and with the outer ends being connected to the tool holding means and the die holding means respectively.

In this embodiment of the invention, the guide posts, support arms and tool holding means and die holding means may therefore constitute a tooling assembly which is in the form of a self-contained assembly mounted to the C-frames. In this way, deflection forces can, during use, exist in the upper and lower frames and in the C-frame, but will tend to be relatively isolated from the tool means and die means and thus from the workpiece since the deflection forces will tend to be balanced equally above and below the workpiece by the pairs of hydraulic rams. The pairs of hydraulic rams will therefore compensate for deflections in frame members thereby minimizing deflections in the tool means and die means during use, and thus in the workpiece during use.

The tool holding means and the die holding means may each comprise a tool manifold and a die manifold respectively, within which hydraulic ram cylinders of the hydraulic rams are provided, and from which hydraulic ram pistons can project.

In accordance with one aspect of this embodiment, the ram pistons are arranged so that they can be displaced into engagement with their associated frame members during use for applied hydraulic fluid during use to force or bias the respective manifolds away from their associated frame members so that the even hydraulic fluid distribution between the cylinders can accommodate deflections of the frame members during use.

The tool holding means may be holding means of any conventional type to hold elongated tools or to hold tool segments in position for bending sheet metal during use.

The invention further extends to a bending press having a tool assembly mounted on the tool holding means. The tool assembly may comprise a single elongated tool, or may comprise a plurality of tool segments having alignment means for maintaining adjacent tool segments in alignment.

The invention further extends to a bending press including a die assembly mounted on the die holding means.

The die assembly may be a die assembly of any conventional type.

In accordance with one aspect of the invention, the die assembly may comprise at least one die block including a die bottom. The die bottom may, in accordance with one aspect of the invention, comprise a split die bottom having tapered walls defining the split to provide for workpiece centering during use.

In an embodiment of the invention, the die bottom may be adjustable in height through displaceable camming means. The camming means may be of various different designs.

In a specific preferred embodiment of this invention, the die block or a die block segment may comprise two laterally spaced guide blocks which are mounted on the die assembly means, and two top plates which are displaceably mounted on the guide blocks, the top plates being connected to each other and being longitudinally displaceable relatively to the guide blocks to adjust the lateral spacing between the top plates.

Any appropriate means may be employed to engage the top plates with the guide blocks, and allow for adjustment of the lateral spacing between them. In a preferred embodiment, the top plates are engaged with the guide blocks through complementary ridge and groove formations which are inclined to the length of the guide blocks for longitudinal displacement of the top plates to result in relative lateral movement of the top plates.

The complementary ridge and groove formations may be in the form of splines or the like, but are preferably in the form of complementary dovetail formations.

The top plates may be displaced relatively to the guide blocks by any appropriate means. Conveniently, for example, they may be displaced by a ball screw rotary device which may be selectively driven by an electric motor or the like. Locking bolts may preferably be provided to lock the top plates in their desired position.

The die block may further include a die bottom mounted between the guide blocks, with the die bottom being longitudinally displaceable relatively to the guide blocks to cause raising and lowering of the die bottom relatively to the guide blocks. Again, the die bottom and the guide blocks may be connected to each other through complementary ridge and groove formations which are inclined to give the appropriate displacement. Again any appropriate means, such as for example a ball screw rotary device may be provided to displace the die bottom. Again any appropriate clamping bolts or the like may be provided to lock the die bottom in its appropriate position for a bending operation.

The invention further extends to a bending press comprising:

(a) a lower frame member;
(b) an upper frame member mounted above the lower frame member;
(c) tool holding means positioned in operative association with one of the frame members for holding bending tool means;
(d) die holding means positioned in operative association with the other of the frame members for holding die means;
(e) a plurality of hydraulic rams mounted in laterally spaced relationship to be operative between the tool holding means and the associated frame member;
(f) the hydraulic rams comprising two outer hydraulic rams mounted proximate opposed ends of the frame member, and a plurality of intermediate hydraulic rams mounted at laterally spaced intervals between the two outer hydraulic rams; and
(g) the hydraulic rams being adapted to be hydraulically connected during use for hydraulic fluid to distribute a load applied to a workpiece evenly between the hydraulic rams and thus provide compensation for frame member deflection during use.

Further in accordance with the invention there is provided a bending press comprising:

(a) a lower frame member;

(b) an upper frame member mounted above the lower frame member;

(c) tool holding means positioned in operative association with one of the frame members for holding bending tool means;

(d) die holding means positioned in operative association with the other of the frame members for holding die means;

(e) a plurality of hydraulic rams mounted in laterally spaced relationship to be operative between the die holding means and the associated frame member;

(f) the hydraulic rams comprising two outer hydraulic rams mounted proximate opposed ends of the frame member, and a plurality of intermediate hydraulic rams mounted at laterally spaced intervals between the two outer hydraulic rams; and (g) the hydraulic rams being adapted to be hydraulically connected during use for hydraulic fluid to distribute a load applied to a workpiece evenly between the hydraulic rams and thus provide compensation for frame member deflection during use.

The invention further extends to a method of improving the accuracy of metal bending operations, which comprises supporting a tool assembly and a die assembly of a bending press relatively to upper and lower frame members of the press by means of a plurality of laterally spaced hydraulic rams which are hydraulically connected for hydraulic fluid during use to evenly distribute a load applied to a workpiece between the hydraulic rams to reduce the effect of frame member deflection.

The invention further extends to a bending press of modular construction for use with elongated workpieces, the bending press comprising three or more C-frames which are positioned in laterally spaced relationship, the C-frames being interconnected by means of die bars for holding dies and by means of tool bars for holding tools, and comprising a plurality of hydraulic rams which are operatively positioned between the C-frames and the tool bars, the hydraulic rams being adapted for connection to a common hydraulic fluid source which can be applied to displace the tool bars towards the die bars to operate the bending press while even distribution of the hydraulic fluid during use will accommodate deflections in the C-frames during use.

In this embodiment of the invention, corresponding hydraulic rams may be preferably be operatively positioned between the die bars and the C-frames.

The invention further extends to a die block for mounting in a bending press, the die block comprising two guide blocks to be mounted in laterally spaced relationship on die block supporting means, and two top plates displaceably mounted on the guide blocks, the top plates being longitudinally displaceable relatively to the die blocks to adjust the lateral spacing between them during use.

The split bottom die provides centering control of the workpiece in the die to prevent or limit longitudinal angle bending deviations due to misalignments of the upper tool and lower die members, press deflections, press yawing (opening of a press C-frame, or sideframe throats, due to the workload forces), and press and tooling manufacturing and tolerance errors. This design can permit the use of simpler and lighter press frames allowing greater deflections. Thus, it becomes more important to control workpiece centering alignment in the die, which the present invention accomplishes, as the angle bending control is thus in the tools.

Hemming, which provides clean workpiece edges, and often permits the use of lighter weight materials, can be accomplished with the tool and die parts remaining in the workpiece bending plane of the upper and lower frame members, without requiring complex tooling, and with easy adjustment control of both the tools, and of the hydraulic workload forces.

The cam actuated split die bottom provides, in the tools, an accurate, easily adjustable, and repeatable control of the workpiece angle, which may be manual, or powered and programmable, to provide quick and easy selection of the angle to be bent, permitting sequential operation of the tools to provide different angles as may be required, and to improve press brake productivity for small to medium part lot sizes by reducing set-up time requirements.

Other, and further objectives and advantages of the present invention will be apparent from the following description and accompanying drawings, which by way of illustration, show preferred embodiments of the present invention, and the principles thereof.

BRIEF DESCRIPTION OF THE DRAWINGS

FIG. 1 is Prior Art, and the front view of a bending press, with bed and ram deflections indicated in an exaggerated manner for ease of illustration.

FIG. 2 is a front view of a precision press brake or bending press, with a plurality of hydraulic cylinders closely spaced along the upper frame, each pair supporting directly a tool segment, embodying the present invention.

FIG. 10 is a cross-sectional view of another lower die assembly, including a die block, a cam of uniform longitudinal cross-section, a split die bottom (positioned to form a 90° angle), a workpiece, and a tool segment.

FIG. 11 is a cross-sectional view of yet another lower die assembly, including a die block, a double saw-toothed cam assembly, and a split die bottom, taken along the centerline of FIG. 12.

FIG. 12 is an end view of FIG. 11.

DETAILED DESCRIPTION OF THE DRAWINGS

Figure 4:
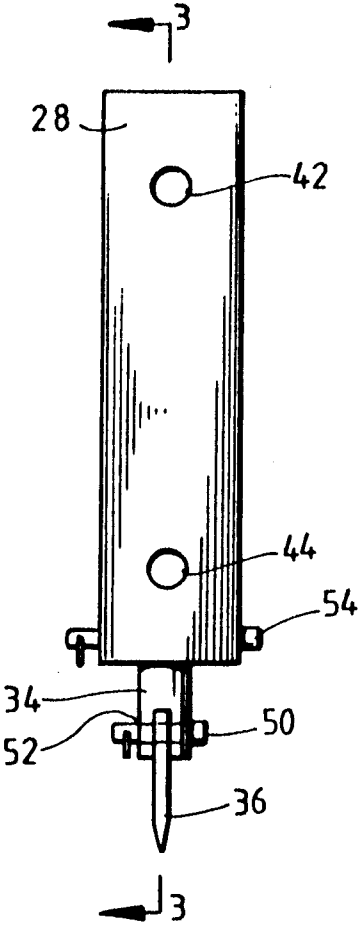
FIG. 4 is an end view of a cylinder manifold assembly.

Referring now to FIG. 1, a bending press 10 of a typical Prior Art type is illustrated. It comprises a ram 12 with tools, which moves freely in a vertical direction, a bed 14, a pair of C-shaped left-hand and right-hand side frames 16 and 18, two hydraulic ram cylinders 20, and a die assembly 22. When the ram 12 is actuated vertically down by the hydraulic cylinders 20, the forces required to bend a workpiece create ram and bed deflections 24, indicated by arrows 26.

Referring to FIG. 2, a precision press brake or bending press 10 of the present invention is illustrated. It comprises an upper frame member 12, and a lower frame 14, both rigidly mounted to a pair of C-shaped left-hand and right-hand side frames 16 and 18, with tool holding means in the form of a hydraulic manifold 28 mounted to and beneath the upper frame 12, and in the plane of the upper and lower frame members 12 and 14, and containing a plurality of closely spaced hydraulic rams 30. The hydraulic rams 30 comprise ram cylinders which are mounted within the hydraulic manifold 28, with each ram cylinder 32 having a ram piston 34 (see FIG. 3) displaceably mounted therein. The ram pistons 34 constitute tool holding means in that tool segments 36 are removably mounted on the ram pistons 34.

The bending press further includes die holding means 38 which is supported on the lower frame member 14, with the die holding means 38 including die means 40.

The bending press 10 is actuated by means of a hydraulic fluid under pressure being fed from a common hydraulic pressure source to the cylinders 32 of the hydraulic rams 30 to move the tool segments 36 directly down towards the die means 40 to bend a workpiece (not shown) located in position in the bending press 10 on the die means 40.

Figure 3:
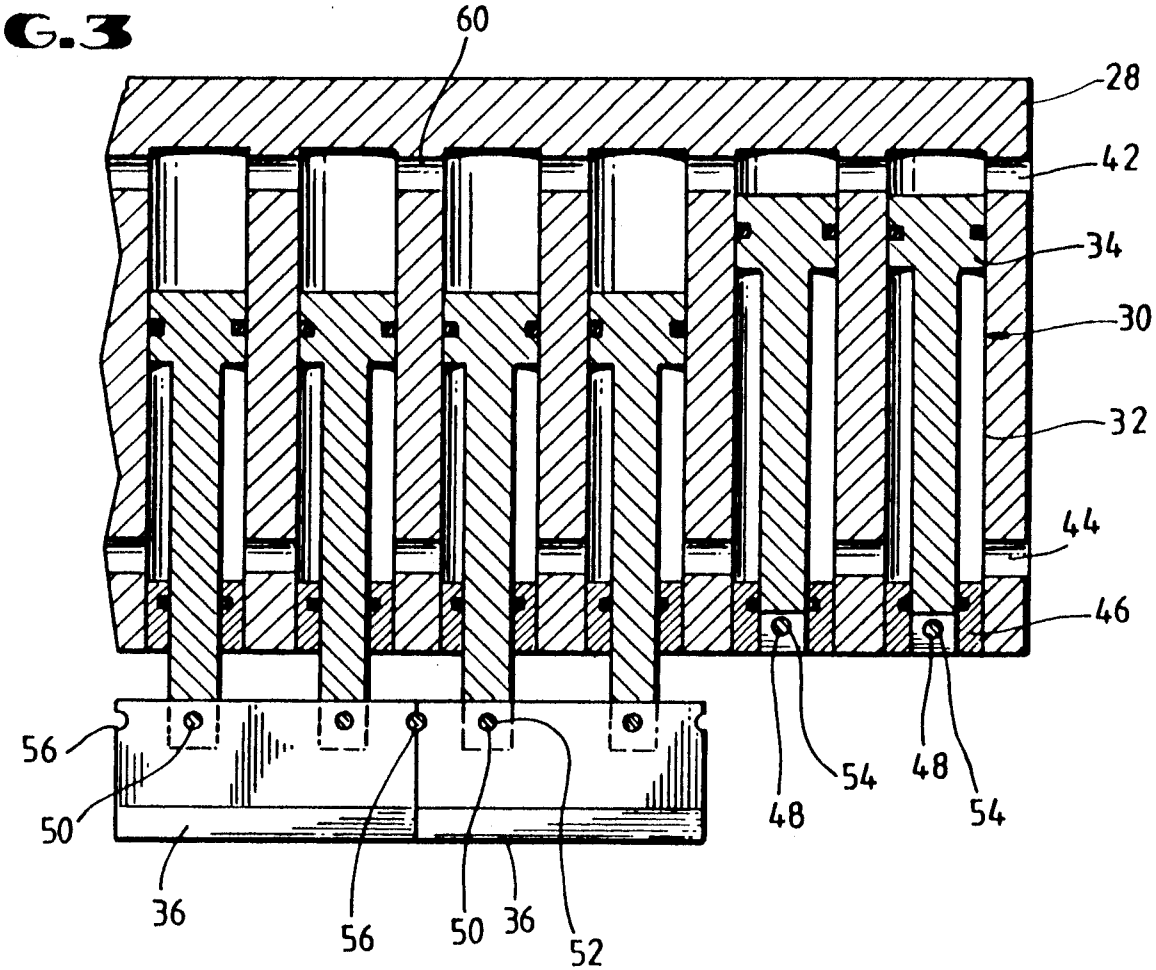
FIG. 3 is a cross-sectional view of a hydraulic manifold assembly of the bending press of FIG. 2 taken along the centerline of FIG. 4.

Referring to FIG. 3 and FIG. 4, the hydraulic manifold 28 comprises a high pressure port 42 to lead hydraulic fluid under pressure from a common source to all of the hydraulic cylinders 30 to provide workpiece bending forces, a low pressure port 44 to return the hydraulic fluid after a work cycle, ram pistons 34, rod end bushings 46 and tool segments 36. In FIG. 3 each tool segment 36 utilizes the work from a pair of hydraulic rams 30. The tool segments are mounted on the ram pistons 34 in such a manner that they will maintain longitudinal alignment. The ram pistons 34 have end holes 48 for use in mounting the tool segments 36 on the ram pistons 34 by means of mounting pins 50 which extend through tool holes 52 in the tool segments 36. The ram pistons 34 have split lower ends within which the trailing ends of the tool segments 36 are received and located by means of the mounting pins 50.

The end holes 48 can also be used to mechanically deactivate selected rams 30 by inserting storing pins 54 through appropriate bores in the rams 30. This is illustrated particularly in FIG. 3 where the two cylinders on the right are in a position where they have been stored out of service by means of the storing pins 54, while the next four rams 30 are shown having tool segments mounted thereon. Additional cylinders or rams, not shown, to the left of the depicted rams 30 could have tool segments 36 mounted thereon in the same way.

With this arrangement the tool segments can be two, three or more rams 30 per tool segment in length. Tool segments, one per cylinder, can be used next to or between longer segments, from which they will obtain their alignment, and for the end of a length of segments to match the workpiece length requirement, as can special length segments somewhat longer or shorter than standard lengths, including end segments with horns. Two or more work stations can be established along a press brake, of desired lengths, by isolating cylinders not in use out of service between, and at the ends of the work stations.

The tool segments 36 have semi-circular cutouts in their opposed edges for receiving undersized pins to assist the tool segments in advancing and retracting together during use. Undersized pins in these cutouts 56 float in the cutouts during use and enable the tool segment 36 to operate independently.

Figure 5:
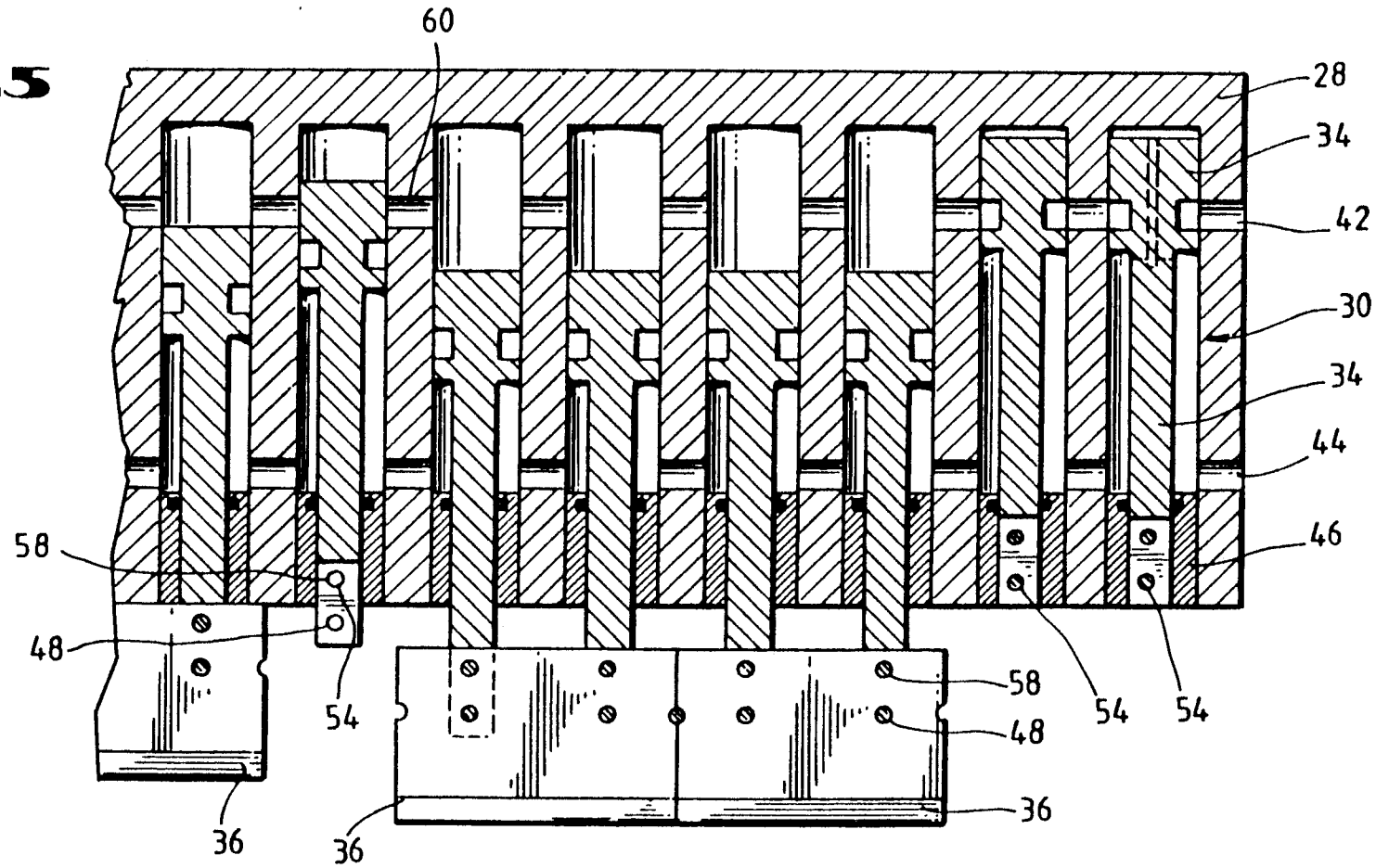
FIG. 5. is a cross-sectional view of an alternative embodiment of a hydraulic manifold along its centerline, in which the ram pistons also function as valves.

Referring to FIG. 5, another hydraulic or cylinder manifold 28 is shown having a high pressure port 42 to the cylinders to provide the workpiece bending forces, a low pressure port 44 to return the fluid after a work cycle, piston-valve-rod assemblies 34, rod end bushings 46, and tool segments 36. This arrangement requires closer tolerances for the valve type piston ends without seals, but permits storage of the cylinder rods not in service in two different positions. The first two cylinders from the right are stored in the bottom holes 48 through the rod ends with storing pins 54 as in FIG. 3. This permits the hydraulic oil entering port 42 to pass through the valve area of these pistons 34 to the next four cylinders 30 which have tool segments 36 mounted therein. The seventh rod from the right is stored in a top hole 58 of the rod end by means of the storing pin 54. This blocks the hydraulic oil flow in hydraulic conduit 60 from actuating additional downstream cylinders 30. The third through sixth cylinders are shown partially extended, while the eight from the right is shown completely retracted, with a tool 36 mounted therein. With this piston-valve-rod 34 design, work stations can be readily defined and isolated from each other. A work station at the right end of the press brake may be actuated from port 42. A work station at the left end may be actuated from a similar port at the left end from a different hydraulic pressure source, while additional ports may be similarly installed between the end ports to actuate additional work stations, all operating separately on their own cycles and workloads. Additionally, two or more work stations may cycle together at a common workload by storing out of service a cylinder between the work stations in a central position allowing the hydraulic oil to by-pass to the next work station. This is particularly useful when a workpiece has an irregular bend line with section cut-outs, punched holes, or other noncontinuous material conditions. The tooling can thus be readily adapted to a specific configuration.

Referring back to FIG. 3, the rams 30 can be made into a simple valve by providing two storage positions 48 and 58 at the rod ends, as in FIG. 5 instead of only one 48 as shown in FIG. 3. By using this extended piston rod in FIG. 3, it can then be raised enough to block the flow of hydraulic fluid or oil, in addition to being used as shown. Another modification which can then be used would be to remove the piston seals, and use tighter tolerances and clearances as required in valves.

Referring again back to FIG. 3, in place of porting through the manifold 28 longitudinally to all cylinders with a common upper high pressure port 42 and a common lower low pressure port 44, pressure ports can be provided on a manifold surface, front and/or rear, to connect individual directional control valves to supply cylinders individually or in groups to provide electric control of desired tool functions. Further refinement will permit single tool segments for each piston rod with tool alignment from the tool into the manifold allowing short section choice for rapid selection of the tooling required for each sequence of bends permitting a flow of a variety of parts quickly through the bending operation.

This bending press can also be made incorporating separate cylinder assemblies, singly or in groups, separated by C-frame members, as required, to form a continuous press brake of any desired length.

With the simplified design for frame and tooling members, a low cost bending press brake may readily be made of any size or length for bending sheet or plate.

Referring to FIG. 6 through FIG. 9, a lower die assembly includes a die block 62, a cam 64 and cam rod 66 which can be made from a single bar of steel, or as an assembly, and a split die bottom 68 actuated up and down by rotating the cam 64. The cam rod 66, which can extend beyond the die block 62 at either or both ends, can be operated from either end manually or with a powered device. The split die bottom 68 centers the workpiece 72 in the die as the bending cycle is being completed by providing accurate contact along the workpiece 72 sides. This workpiece centering is provided by the split die bottom 68 having tapered walls 70 which define the split. When the workpiece 72 approaches the die bottom 68 slightly off-center, if even for only limited distances, it will make contact first with the side 70 toward which it is off-center causing movement to the die center assuring a more consistent and accurate angle along the workpiece bend.

Figure 7:
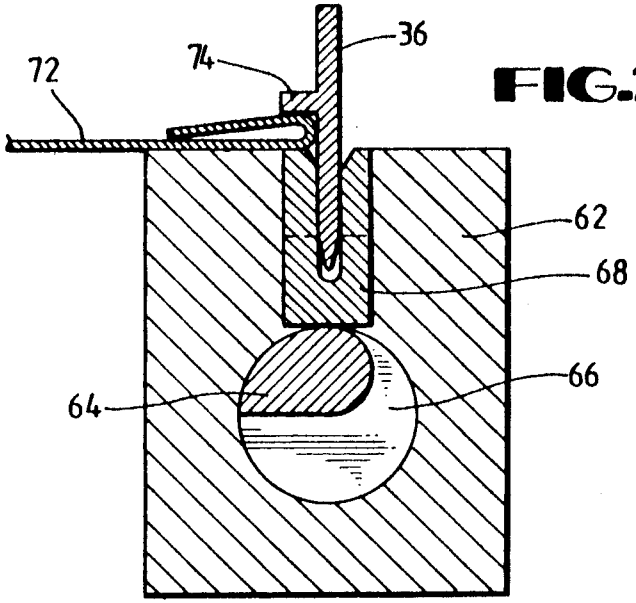
FIG. 7 is a cross-sectional view of a lower die assembly, includin,g a die block, a cam, a split die bottom (raised), a workpiece (being hemmed), and a tool segment.
Figure 6:
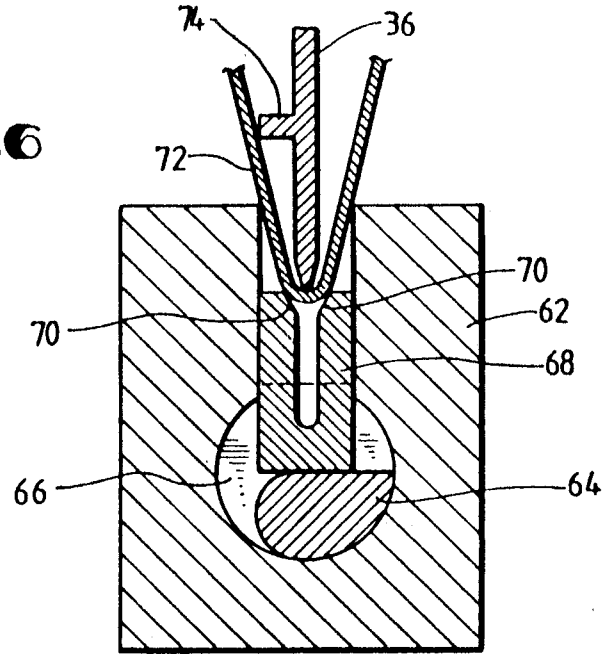
FIG. 6 is a cross-sectional view of a lower die assembly, including a die block, a cam, a split die bottom (lowered), a workpiece, and a tool segment.

In FIGS. 6 and 7 workpieces 72 are shown in the process of being pressed by tool segments 36. The tool segment 36 includes a hemming flange 74 which permits hemming of the workpiece 72 as shown in FIG. 7 without the need to change the tool segments 36 or the alignment of the tool segments.

During bending, as the bottom of a bend in the die moves from the centerline of the die, the amount of bend becomes greater, an error which the present invention can correct. Conditions which can cause off-center tool and die alignment include press frame deflections, press yawing (opening of a press C-frame, or side-frame throats, due to the workload forces), press and tooling manufacturing and tolerance errors, wear of parts, and assembly misalignments.

The design of the present invention can allow the use of lighter and simpler press brake frame members permitting greater deflections since these deflections are not cumulative to the workpiece as the work forces are applied directly in the tools, isolated from the supporting structures.

The cam actuated split die bottom provides, in the tools, an accurate, repeatable, and easily adjustable control of the workpiece angle which may be manual, or powered and programmable.

The segmented tooling, directly operated by single cylinders, cylinder pairs, or cylinder groups assures equal workloading to the workpiece continuously along the bendline of the workpiece throughout the bend cycle resulting in accurate parts.

Figure 9:
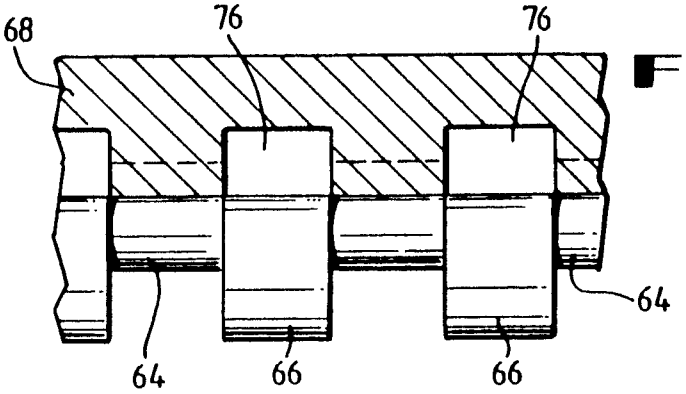
FIG. 9 is a longitudinal view section of a cam, and a split die bottom (raised), as in FIG. 7.
Figure 8:
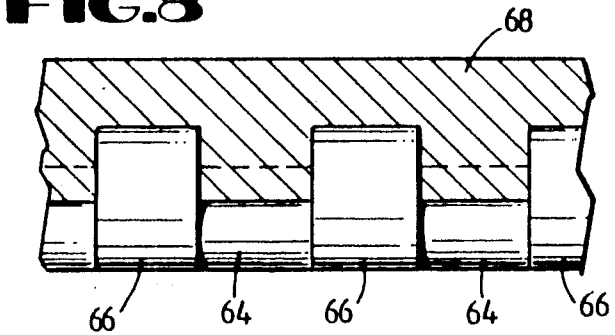
FIG. 8 is a longitudinal view section of a cam, and a split die bottom, (lowered), as in FIG. 6.

The cam 64 and cam rod 66 in FIG. 8 and FIG. 9 is ideally made from a single steel rod of the diameter of the hole longitudinally through the die block 62, less design clearances. The smaller areas of the cam 64 are machined at intervals along the steel rod to actuate vertically the die bottom 68 as the cam 64 is rotated. The cut-out areas 76 of the die bottom, as shown in FIG. 9, permit the die bottom 68 to be lowered between the full diameter sections 66 of the cam 64, which are load bearing supports for the split die bottom 68 in the die block assembly 62, and are at similar intervals.

Referring now to FIG. 10, another lower die assembly comprises a die block 62 which has a continuous longitudinal bore to accept the cam rod 64, and a slot from this bore to its upper surface to accept the split die bottom 68. The cam rod 64 is made from a continuous round bar and, when finished to the desire contour, has the same cross-section throughout its length. Rotation of the cam rod 64 from its end, or ends, provides vertical location for the die bottom 68.

Referring now to FIG. 11 and FIG. 12, another lower die assembly, a die block 62 houses a double saw-toothed cam assembly 65 consisting of a longitudinally actuated member 64, a fixed lower member 67, and an upper member 69 which moves vertically lifting a bottom die 68. The double saw-tooth configuration permits a lift of the bottom die 68 at twice the rate of lift provided by a similar single saw-tooth cam for the required travel of the actuated member 64, thus reducing both the length requirement of the cam teeth and the travel requirement, resulting in a more compact and rigid design.

Figure 14:
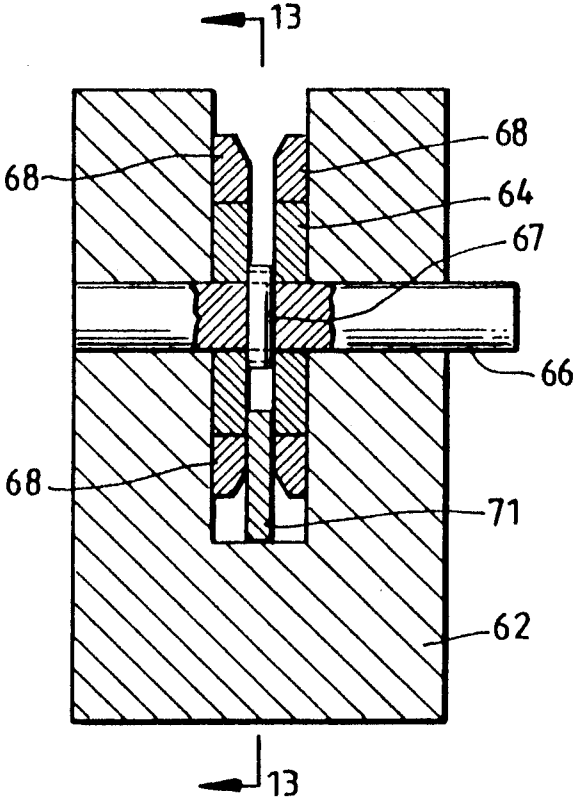
FIG. 14 is an end view of FIG. 13.
Figure 13:
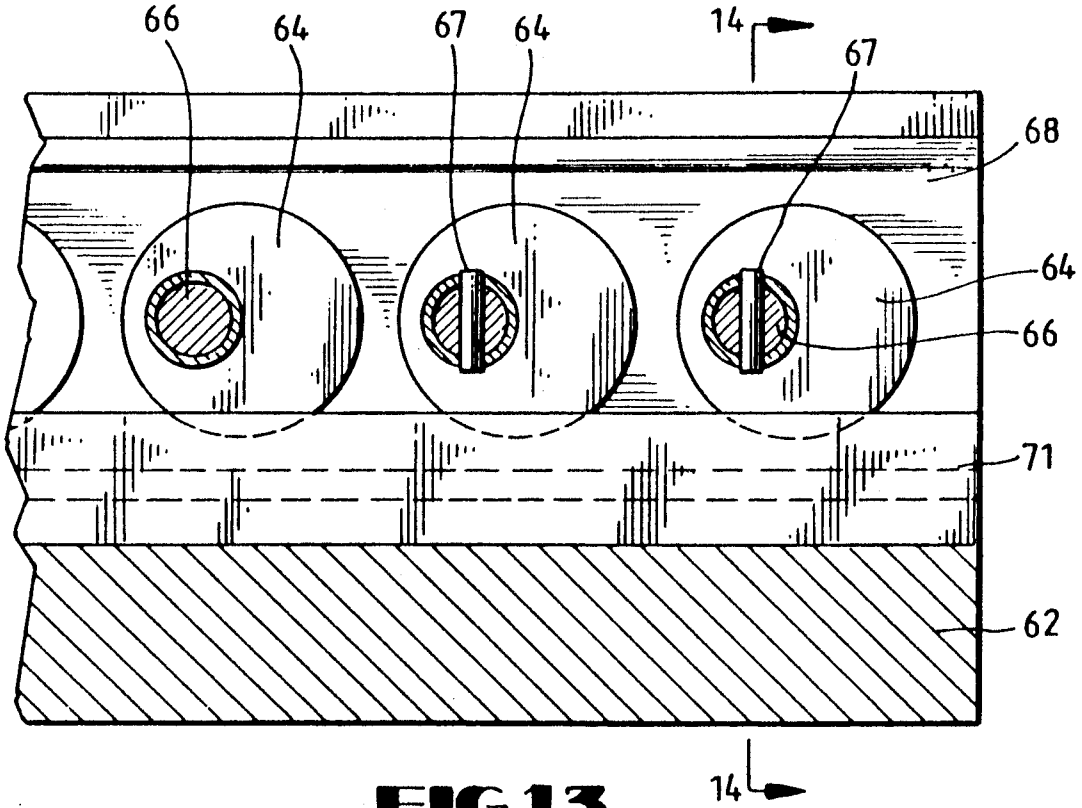
FIG. 13 is a cross-sectional View of still another lower die assembly, including a die block, a plurality of cams, a split die bottom, a plurality of cam drive shafts, and a spacer, taken along the centerline of FIG. 14.

Referring to FIG. 13 and FIG. 14, another lower die assembly, a die block 62 houses a plurality of cams 64, each shaped like a spool with an off-center hub through which a cam rod 66 passes. A drive pin 67 connects a cam with the rod 66 when the rod is to be driven; otherwise, no drive pin is required as the cam will follow the motion of the assembly. The split die bottom 68 is comprised of a pair of opposed plates, separated by a spacer 71, the plates being raised or lowered as the cams 64 are rotated. In FIG. 13, the first two cams 64 from the right each have a drive pin 67, and thus may be driven by the rod 66. Though the third cam 64 has no drive pin, the third cam is positioned from the plates 68 while turning on its shaft 66.

The described tools can provide precise and quick processing while making possible a sequence of bending operations with different bend angles without the need for changing the work tools, while further providing that the bend angle is not influenced by variations in sheet thickness.

The tooling can be reversed vertically with the die adapted to the upper frame, with the cylinders actuated from the lower frame.

Furthermore, the invention being thus described, it will be obvious that the same may be varied in many ways. Such variations are not to be regarded as a departure from the spirit and scope of the invention, and all such modifications are intended to be included within the scope of the claims.

With reference to FIGS. 15–19 of the drawings, reference numeral 10 refers to a preferred embodiment of a bending press or precision press brake in accordance with this invention.

The bending press 10 comprises a lower frame member 14 and an upper frame member 12 which are rigidly connected together through a pair of laterally spaced C-frames 78.

The bending press 10 further comprises tool holding means in the form of a hydraulic manifold 28 which is positioned in operative association with the upper frame member 12 for holding bending tool means in the form of elongated tool segments 36. The tool segments may be of any desired lengths. In certain applications of the invention, in place of having a plurality of tool segments 36, one elongated tool segment extending the length of the press 10, may be used.

The bending press 10 further includes die holding means in the form of a die assembly or manifold 38. The die manifold 38 holds a die means 40 which is mounted thereon.

The bending press 10 further comprises a plurality of first hydraulic rams 30 which are mounted in laterally spaced relationship to be operative between the tool holding means or tool manifold 28 and the associated upper frame member 12.

The first hydraulic rams 30 comprise ram cylinders 32 which are housed within the tool manifold 28, and ram pistons 34 which are disposed within the cylinders 32, and which project from the cylinders 32 into engagement with the upper frame 12 through piston blocks 80 which are connected both to the upper frame 12 and to the ram pistons 34.

The bending press 10 further includes a plurality of second hydraulic rams 31. Each hydraulic ram 31 comprises a ram cylinder 33 which is housed within the die holding means 38, and within which a ram piston 35 is provided.

The ram pistons 35 are provided within the cylinders 33 such that the ram pistons project from the cylinders 33 to abut the upwardly directed surface of the lower frame member 14.

In both the first hydraulic rams 30 and in the second hydraulic rams 31, the hydraulic rams are evenly spaced across the length of the bending press 10. In each set of hydraulic rams, there is an outer hydraulic ram proximate each end of the bending press 10, with the remaining hydraulic rams evenly spaced between the outer hydraulic rams.

Furthermore, the first hydraulic rams 30 and the second hydraulic rams 31 are arranged in corresponding vertically aligned pairs.

Figure 17:
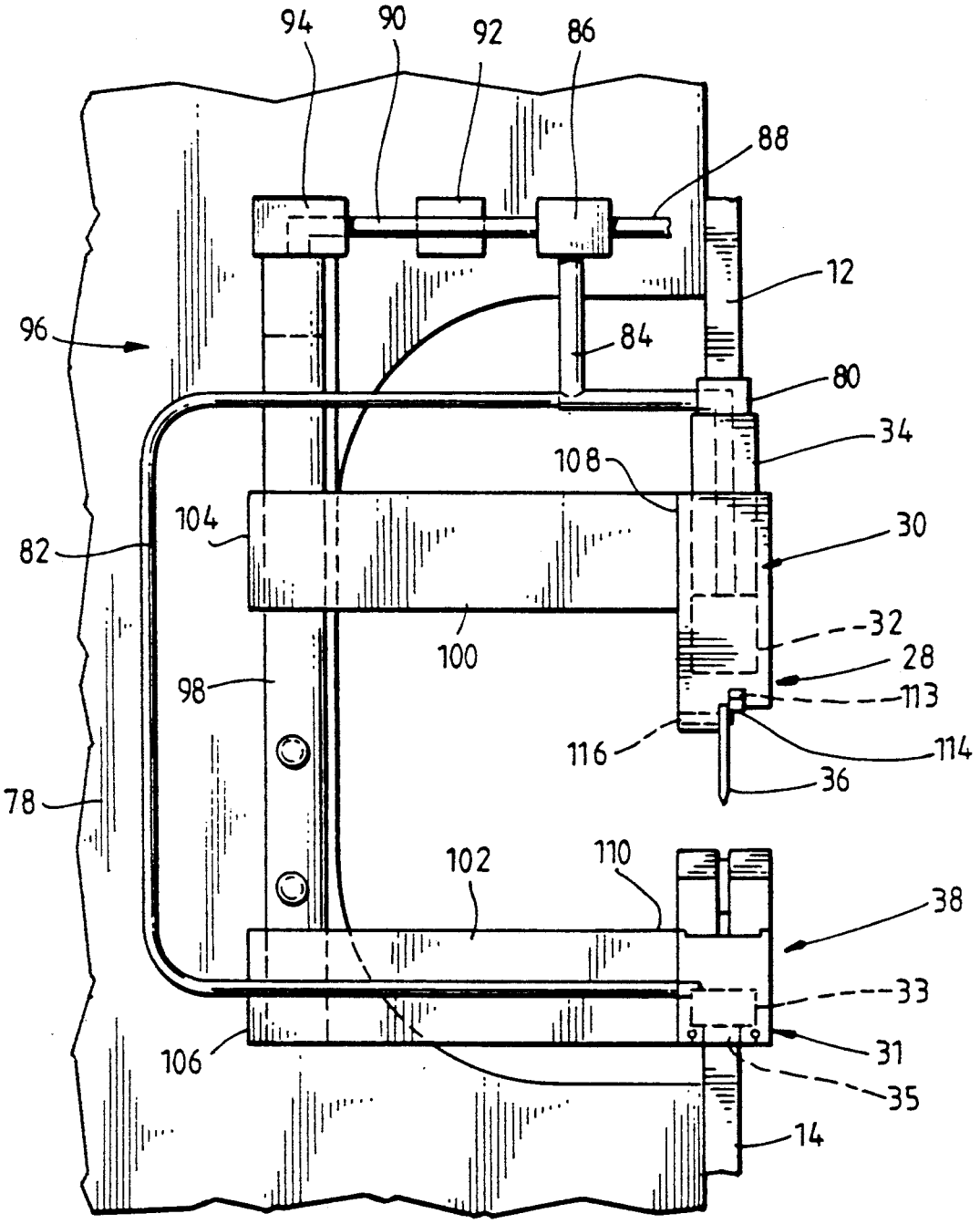
FIG. 17 shows a fragmentary side elevation of the bending press of FIG. 16.

As shown in FIG. 17, each vertically aligned pair of first hydraulic ram 30 and second hydraulic ram 31 are hydraulically connected by means of a hydraulic conduit 82. As shown in FIG. 17, each hydraulic conduit 82 is in communication with the cylinder 33 through the base of the cylinder 33, and is in communication with the cylinder 32 by means of a conduit which extends through the piston block 80, through the core of the piston 34 and into the cylinder 32. Each hydraulic conduit 82 is further connected by means of a branch conduit 84 to a control valve 86. The control valve 86 may be of any suitable type. It may conveniently be an electrically operable solenoid valve of conventional type.

The control valve 86 of each pair of first and second hydraulic rams 30 and 31 has a fluid conduit 88 leading to a common source of hydraulic fluid under pressure. Thus, during use, when the control valve 86 admits hydraulic fluid to any hydraulic conduit 82, the pressure in the hydraulic conduit 82 and thus in the cylinders 32 and 33 of all of the operative hydraulic rams 30 and 31, will be the same.

The fluid conduit 88 has a branch conduit 90 to lead hydraulic fluid from the hydraulic fluid pressure source via a controllable return valve 92 to a return cylinder head 94.

The bending press 10 further includes a tool assembly 96 which is shown particularly in FIG. 17. The tool assembly 96 comprises a pair of vertically extending guide posts 98 which are mounted in laterally spaced relationship proximate opposed ends of the press 10, and in rearwardly spaced relationship relatively to the upper and lower frame members 12 and 14.

The tool assembly 96 further oomprises a pair of upper support arms 100 and a pair of lower support arms 102. Each support arm 100 and 102 has an inner end 104 and 106 respectively, and an outer end 108 and 110 respeotively. The inner ends 104 and lo6 of the upper and lower support arms 100 and 102 are slidably mounted on the guide posts 98, while their outer ends 108 and 110 are connected to the tool manifold 28 and die holding means 38 respectively.

The upper and lower support arms 100 and 102 therefore guide the tool manifold 28 and the die holding means 38 during displacement of the tool manifold and die holding means between their operative and inoperative positions.

The return cylinder heads 94 communicate with the two guide posts 98 so that hydraulic fluid can be applied through the branch conduit 90, under the control of the return valve 92, to return the pair of upper support arms and their associated tool manifolds 28, to their inoperative position once the pressing operation has been completed.

By having the first hydraulic rams hydraulically connected to a common source of hydraulic fluid under pressure, and by having the second hydraulic rams connected to the same source of hydraulic fluid under pressure, the pressure of the hydraulic fluid will be evenly distributed throughout the hydraulic rams during use.

Figure 16:
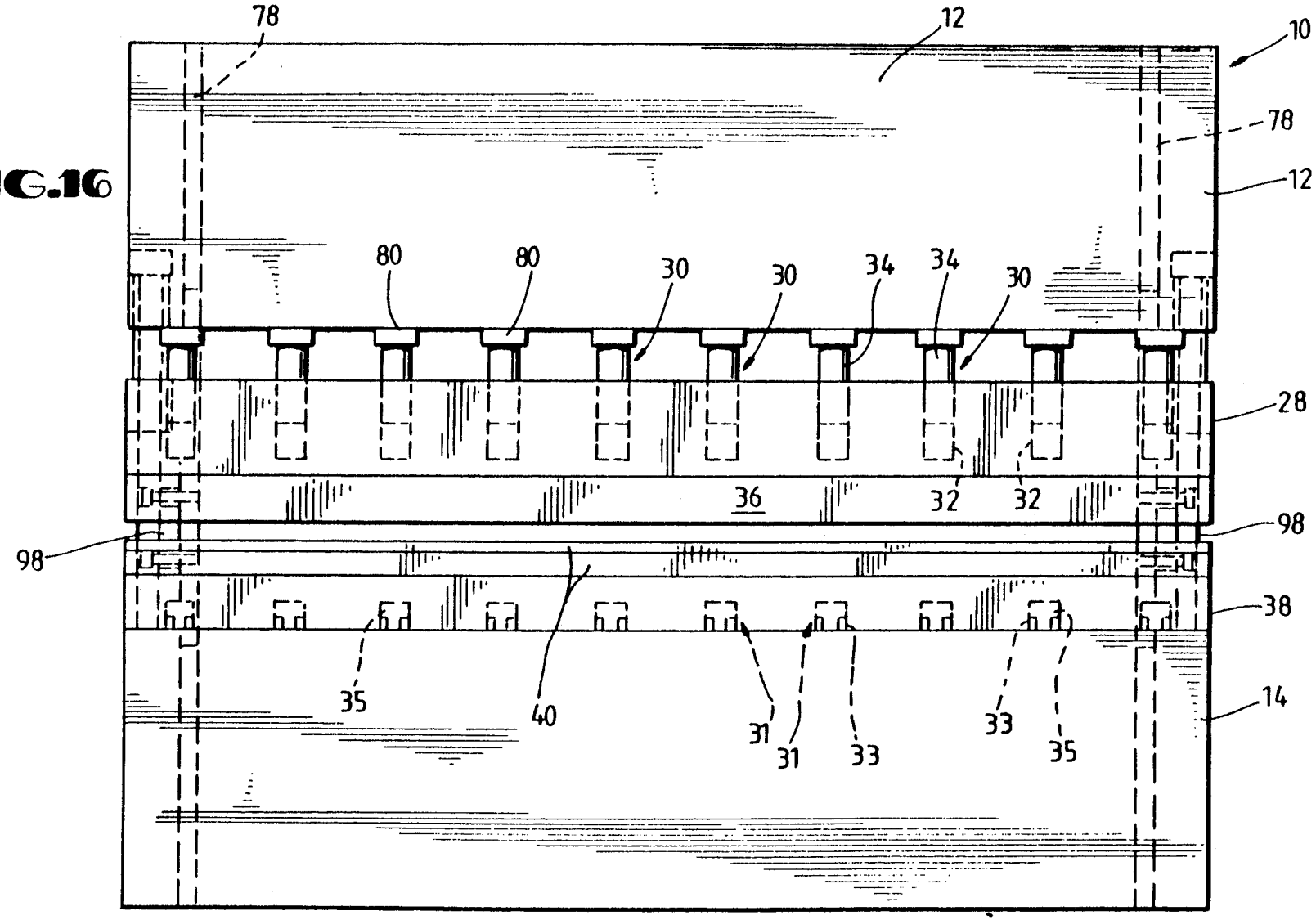
FIG. 16 shows a front elevation of the bending press of FIG. 15 in is mid stroke.

In FIG. 16 of the drawings, the bending press 10 is shown in its mid-stroke position where the tool manifold 28 is being displaced downwardly under the action of the hydraulic fluid forcing the ram pistons 34 against the piston blocks 80 and thus against the upper frame member 12.

Figure 15:
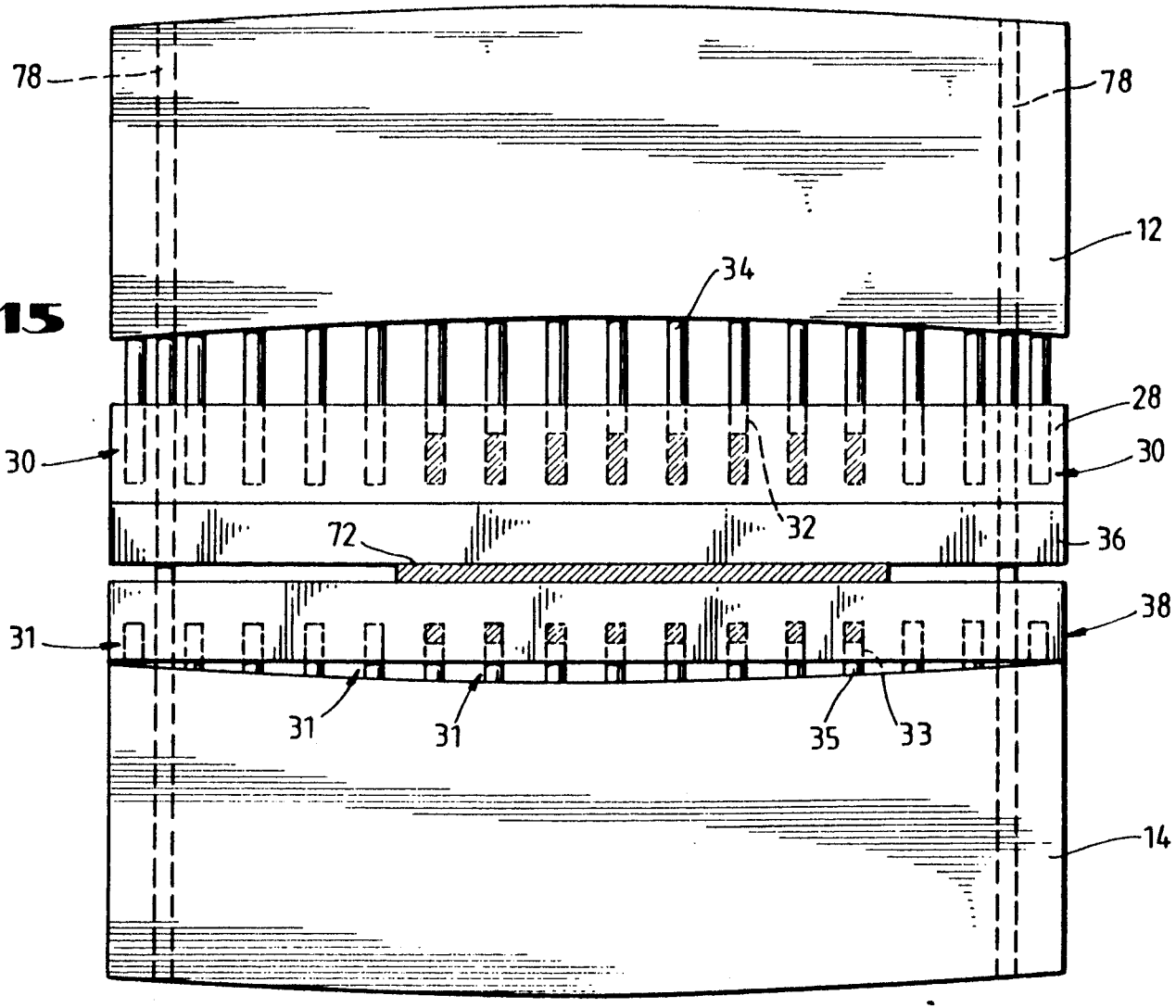
FIG. 15 shows a diagrammatic front view of a preferred embodiment of a bending press or precision press brake in accordance with this invention, in an operative condition, with the deflection of the frame members illustrated in exaggerated form for the sake of clarity.

The pistons 35 of the second hydraulic rams 31 have a very short stroke. They basically are designed to move only sufficiently to take up any space created between the die holding means 38 and the lower frame member 14 caused by deflection of the lower frame member 14 during use. A gap is not visible between the die holding means 38 and the lower frame member 14 in FIG. 16 since the deflection would be very minimal. However, in FIG. 15 of the drawings, the deflection of the upper and lower frame members 12 and 14 has been exaggerated to demonstrate the operation of the preferred embodiment of this invention. In FIG. 15 the bending press 10 is shown in its operating condition where the tool segments 36 are bearing against the workpiece 72 to bend the workpiece 72 in the die means 38.

As can be seen particularly in FIG. 15, as the load is applied to the workpiece 72, the upper and lower frame members 12 and 14 will deflect in typical fashion. The deflection forces therefore exist in the upper and lower frame members and in the C-frames 78. However, because the operative hydraulic rams 30 and 31 are evenly balanced from the common source of hydraulic fluid, the displacement of the ram pistons 34 and 35 will compensate for or accommodate the deflection of the upper and lower frame members 12 and 14, thereby shielding or substantially isolating the deflections from the tool manifold 28, from the die means 38, and thus from the tool segments 36 and the workpiece 72.

This provides the advantage that the forces applied to the workpiece 72 will tend to be more equal and uniform along the workpiece thereby reducing or substantially eliminating distortion and deflection of the workpiece during bending.

Thus the frame assembly comprising the upper and lower bearing frame members 12 and 14 and the C-frame 78 can be rigid to absorb the stress forces, while the resulting deflections are isolated from the tool and die assembly and thus from the workpiece.

The forces in the die means 38 and in the hydraulic manifold 28 and thus in the tool segments 36 will reduce if not substantially eliminate deflection because they are substantially balanced.

By controlling the control valves 86, hydraulic fluid under pressure can be applied selectively to the aligned pairs of upper and lower hydraulic rams 30 and 31. As shown in FIG. 15, the workpiece is shorter than the length of the bed of the bending press. For this reason only the pairs of hydraulic rams 30 and 31 which are above and below the workpiece have been activated through control of the control valves 86. Thus the three sets of the hydraulic rams on the right-hand side of the workpiece 72 and the five sets of hydraulic rams on the left-hand side of the workpiece 72 have not been activated by maintaining their control valves 86 in a closed condition. This provides the advantage that there is no load in the overhang area beyond the workpiece 72 thereby minimizing the deflection effects which would be caused by any such overhang.

In the same way, by controlling selected control valves 86, different sets of hydraulic rams can be activated to permit the simultaneous handling of a plurality of workpieces in the press 10.

The hydraulic system may be of any conventional type, and tonnage control may simply be a function of pressure control.

By isolating the working zone in accordance with the preferred embodiment of this invention, the deflections and deformations which are inherent in the prior art designs, and which are transferred through the tooling to the workpieces to result in bending errors, are substantially reduced if not eliminated in instances.

In a specific example of the preferred embodiment of this invention, where the bending press has a length of say five feet, for bending ten-gauge or lighter sheet metal, hydraulic rams may be spaced at six-inch intervals with for example, each hydraulic cylinder having a diameter of about one and three-quarter inch, and with a piston length of about four and one-half inches and a stroke of about three and three-quarter inch. In this embodiment the hydraulic manifold may have a thickness of about two and one-half inches. In this same embodiment the lower pistons 33 of the second hydraulic rams 31 may have a stroke of about one-quarter of an inch.

Because deflections of the upper and lower frame members and of the C-frame 78 can be accommodated, the upper and lower frame members 12 and 14 can be lighter because larger deflections can be accommodated.

The C-frames 78 may be connected to the upper and lower frame members 12 and 14 by any appropriate means. In one embodiment of the invention, the C-frames may be connected to the upper and lower frame members 12 and !4 through forwardly directed pivot pins. This provides limited lateral pivotal movement of the C-frames relatively to the upper and lower frame members thereby reducing the tendency for distortion of the C-frame 78 to cause corresponding distortion of the upper and lower frame members 12 and 14.

Figure 19:
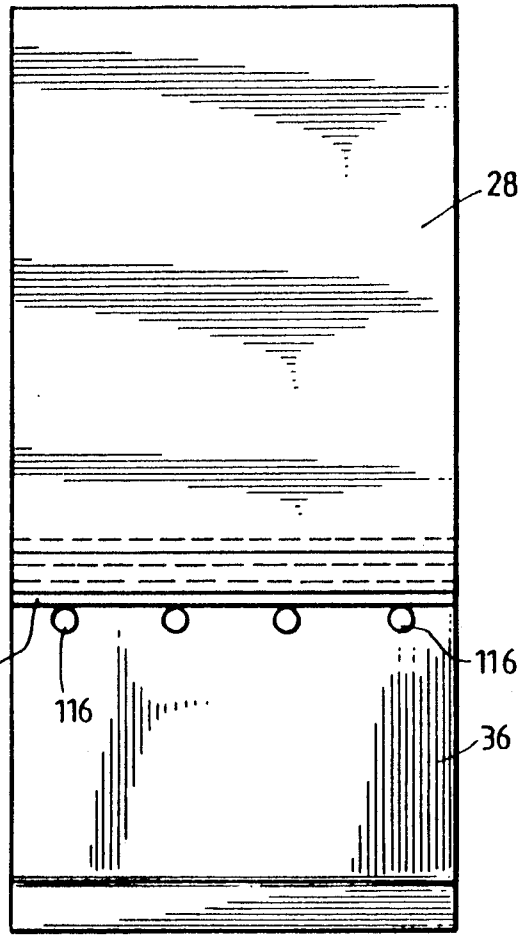
FIG. 19 shows a fragmentary front elevation of the tool holding means of FIG. 18.
Figure 18:
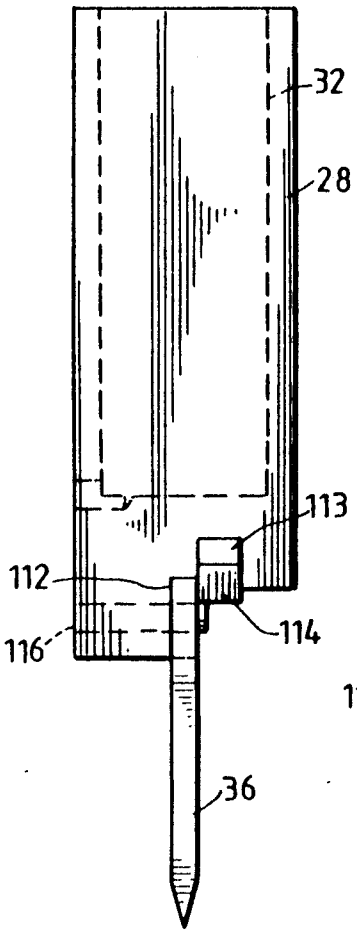
FIG. 18 shows, to an enlarged scale, a diagrammatic end view of a preferred embodiment of tool holding means in accordance with this invention.

The tool holding manifold 28 is illustrated in more detail in FIGS. 18 and 19. The tool manifold 28 has an elongated downwardly directed tool slot for receiving the base portions of the tool segments 36. It further has an adjacent elongated locking slot 113 which is directed downwardly, and whioh houses a displaceable locking tool bar 114. The locking tool bar is displaceable between an extended position as shown in FIGS. 18 and 19 to hold the tool segments 36 in position, and a retracted position where it has been displaced upwardly into the locking slot 113, to permit removal of the tool segments 36.

The tool segments 36 are prevented from falling out by being placed onto tool pins 116.

Instead of one elonqated tool bar 114, a plurality of tool bars may be employed.

The tool locking mechanism of this invention is both simple and effective, and easy to operate.

Figure 21:
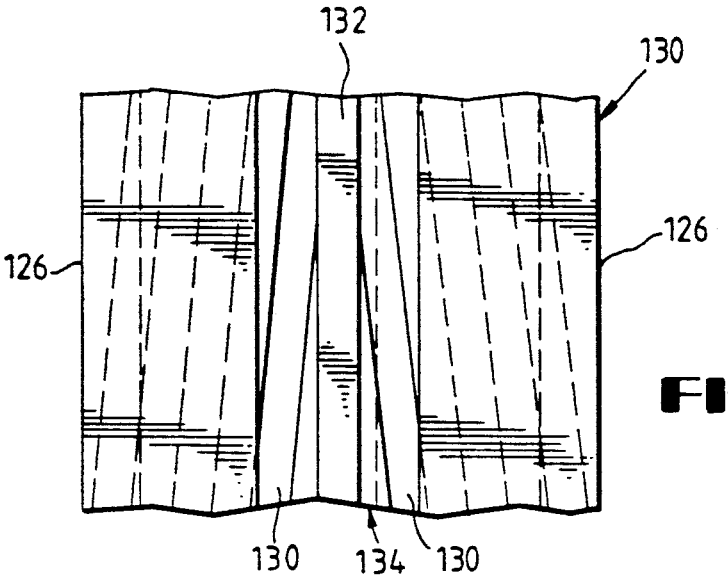
FIG. 21 shows a fragmentary plan view of the die block of FIG. 20.
Figure 20:
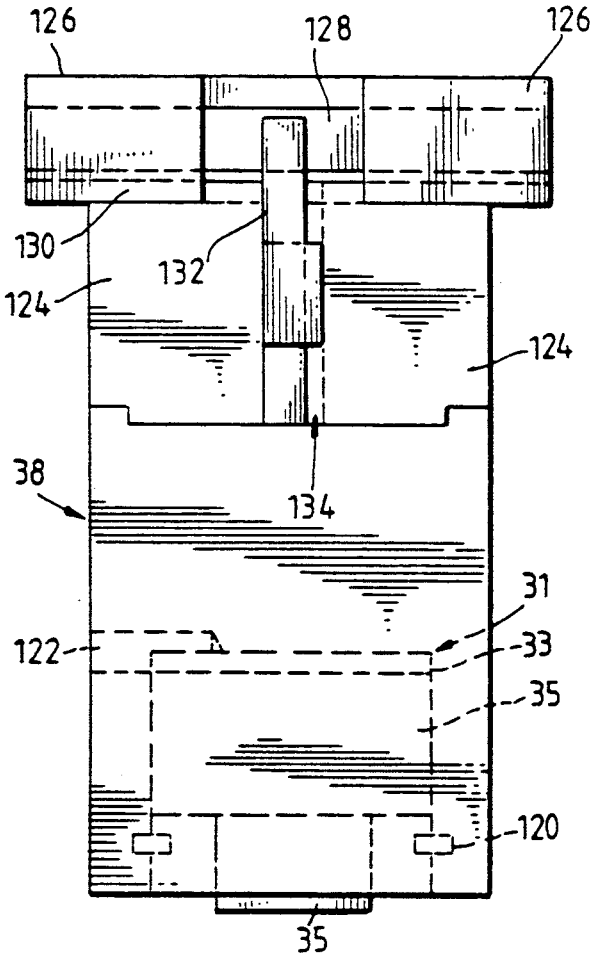
FIG. 20 shows a fragmentary end elevation, to an enlarged scale, of a die block mounted in position in the bending press of FIGS. 15 and 16.
Figure 22:
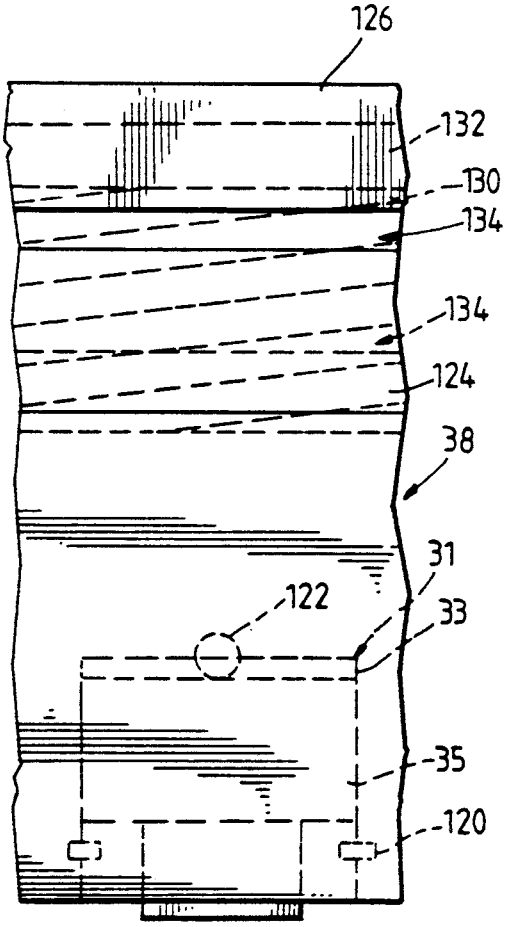
FIG. 22 shows a fragmentary side view of the die block of FIG. 20.

The die means 38 of the bending press 10 illustrated in FIGS. 15–17, is illustrated in more detail in FIGS. 20–22.

In FIGS. 20 and 22, the snap rings 120 which hold the pistons 35 from falling out, are shown clearly. Also the port 122 through which the hydraulic conduit 82 leads the hydraulic fluid into the cylinder 33, is clearly visible.

The die means or die assembly 38 comprises two laterally spaced guide blocks 124 which are mounted on the die means 38. It further comprises two top plates 126 where are displaceably mounted on the guide blocks 124.

The top plates 126 are longitudinally displaceable relatively to the guide blocks 124 to adjust the lateral spacing between the top plates 126.

The top plates 126 are connected for longitudinal displacement in unison by a guide pin 128 at one end. The guide pin 128 engages slidably within bores in the top plates 126.

The top plates are engaged with the guide blocks through complementary ridge and groove formations 130 which are inclined to the length of the guide blocks 124 for longitudinal displacement of the top plates to result in relative lateral movement of the top plates 126.

The complementary ridge and groove formations are preferably, as shown in FIG. 21, in the form of dovetail formations.

The top plates 126 may be longitudinally adjusted manually or conveniently by means of a conventional ball screw rotary device driven by an electric motor. Suitable locking means may be provided for locking the top plates in their desired position. This may, for example, be in the form of bolts which extend through elongated slots in the top plates, and engage with the guide blocks 124.

The die assembly 38 further includes a die bottom 132 which is mounted within the guide blocks 124, and which is longitudinally displaceable in the same way as the top plates 126, to cause raising and lowering of the die bottom relatively to the guide blocks 124.

To achieve this raising and lowering, the die bottom is engaged with one of the guide blocks 124 by means of complementary ridge and grooved formations 134 which are inclined to the horizontal plane.

The slope of the dovetail formations 130, and the slope of the complementary formations or splines 134 may conveniently be about ten to one to achieve effective utilization and sufficient frictional resistance to displacement under load.

This embodiment of the invention provides the advantage that the width and depth of the die can readily and effectively be adjusted with precision to allow for a wide range of operations.

Figure 23:
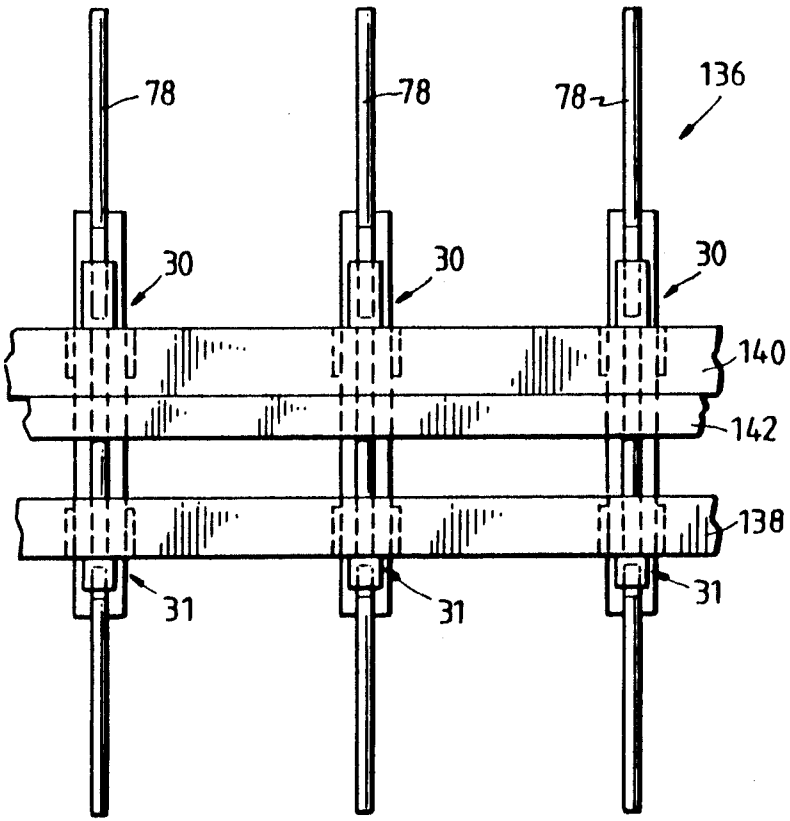
FIG. 23 shows a diagrammatic view a bending press of modular construction for use in bending elongated objects.

With reference to FIG. 23 of the drawings, reference numeral 136 refers generally to a bending press of modular construction for use with elongated workpieces.

The bending press 136 comprises three or more C-frames which are positioned in laterally spaced relationship.

In the drawing only three C-frames are shown, and the additional modular C-frames on either side are omitted.

In the modular bending press 136, the C-frames 78 are interconnected by means of die bars 138 for holding dies, and by means of tool bars 140 for holding tools 142.

The bending press 136 further comprises a plurality of first hydraulic rams 30 and a plurality of second hydraulic rams 31 which correspond with those described with reference to, for example, FIGS. 16 and 17 of the drawings.

The hydraulic rams 30 are operatively positioned between the C-frame 78 and the tool bars 140, whereas the hydraulic rams 31 are operatively positioned between the C-frame 78 and the die bar 138.

The hydraulic rams 30 and 31 are connected to a common hydraulic fluid source which can be applied to displace the tool bars towards the die bars to operate the bending press while even distribution of the hydraulic fluid during use will accommodate deflections in the C-frames during use.

While the tool bars and die bars 140 and 138 are shown as being in the form of single elongated bars, they may be in the form of segmented bars which are provided to extend between two or more adjacent pairs of C-frames. The tool segments 142 and the die blocks mounted on the die bars 138, may likewise be elongated or may be in longitudinally positioned segments.

The C-frames may be connected together by means of upper and lower frame rods or the like, if desired.

It will be appreciated that the spacing between the C-frames, and the rigidity of the tool bars and die bars will have to be such that the deflection of the tool bars and die bars during use will not be excessive for the precision required for the bending press 136.

The bending press 136 provides the advantage that it may be constructed to provide any desired length within reason by utilizing additional C-frame 78 and additional tool bar 140, die bar 138, and tool 142 segments. While there will be some trade off in precision, this embodiment can have utility in a number of applications where elongated members need to be bent and where precision is not at such a premium.

I claim:

1. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) deactivation means for selectively deactivating one or more of the hydraulic rams.

2. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) a pair of vertically extending guide posts which are mounted in laterally spaced relationship rearwardly spaced relatively to the upper and lower frame members, and including a pair of upper and a pair of lower support arms which have inner and outer ends, their inner ends being slidably mounted on the guide posts and their outer ends being connected to the tool holding means and the die holding means rsepectively.

3. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) the tool holding means comprises a manifold within which hydraulic ram cylinders of the first hydraulic rams are provided, and from which hydraulic ram pistons can project.

4. A bending press according to claim 3, in which the ram pistons project from the manifold into engagement with the associated frame member for applied hydraulic fluid during use to force the manifold away from the frame member to operate the bending press while even hydraulic fluid distribution between the cylinders accommodates deflection of the frame member during use.

5. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) the die holding means comprises a manifold within which hydraulic ram cylinders of the second hydraulic rams are provided, and from which cylinders hydraulic ram pistons can project.

6. A bending press according to claim 5, in which the ram pistons project from the manifold into engagement with the associated frame member for applied hydraulic fluid during use to be evenly distributed between the cylinders to accommodate deflection of the frame member during use.

7. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) said tool holding means comprises a holder having an elongated tool slot for receiving a base of a tool, having an adjacent elongated locking slot housing a disspacable locking tool bar which is displaceable between a retracted position to release a tool, and an extended position to lock a tool in the tool slot, and tool pin means for pinning a tool in the tool slot;

(j) a tool assembly mounted on the tool holding means; and (k) the tool assembly comprises a plurality of tool segments having lateral alignment formations for maintaining adjacent tool segments in alignment.

8. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) a die assembly mounted on the die holding means;

(j) said die assembly comprises at least one die block segment including a die bottom;

(k) said die bottom comprises a split die bottom having tapered walls defining the split to provide for workpiece centering during use;

(l) said dye bottom is adjustable in height through displaceable canning means; and (m) the canning means comprises an elongated round bar which is pivotably mounted withint he dye holding means, the round bar having bearing sections to pivotably support the bar, and lift sections to comprise cam means.

9. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) a die assembly mounted on the die holding means;

(j) the die assembly comprising at least one die block segment including a die bottom; and (k) the die block segment comprising two laterally spaced guide blocks which are mounted on the die assembly means, and two top plates which are displaceably mounted on the guide blocks, the top plates being longitudinally displaceably relatively to the guide blocks to adjust the lateral spacing between them.

10. A bending press according to cliam 9, in which the guide blocks and top plates are engaged with each other through complementary ridge and groove formations which are inclined to the length of the guide blocks for longitudinal displacement of the top plates to result in relative lateral movement of the top plates.

11. A bending press according to claim 9 or claim 10, including a die bottom mounted between the guide blocks, the die bottom being longitudinally displaceable relatively to the guide blocks to cause raising and lowering of the die bottom relatively to the guide blocks.

12. A bending press according to claim 11, in which the die bottom and guide blocks are engaged with each other through complementary ridge and groove formations which are inclined to effect raising and lowering upon relatively longitudinal displacement of the die bottom and guide blocks.

13. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(f) the hydraulic rams comprising two outer hydraulic rams mounted proximate opposed ends of the frame member, and a plurality of intermediate hydraulic rams mounted at laterally spaced intervals between the two outer hydraulic rams;

(g) the hydraulic rams being adapted to be hydraulically connected during use for hydraulic fluid to distribute a load applied to a workpiece evenly between the hydraulic rams and thus provide compensation for frame member deflection during use; and (h) said tool holding means comprises a manifold within which hydraulic ram cylinders of the hydraulic rams are provided, and from which cylinders hydraulic ram pistons project.

14. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) a pair of vertically extending guideposts which are mounte din laterally spaced relationship rearedly spaced relatively to the upper and lower frame members, and including a pair of upper and a pair of lower support arms which have inner and outer ends, their inner ends being slideably mounted on the guide posts and the outer ends being connected to the tool holding means and the die holding means, respectively.

15. A bending press, comprising:

(a) a fixed lower frame member;

(b) a fixed upper frame member mounted above the lower frame member;

(c) tool holding means positioned in operative association with one of the frame members for holding bending tool means, said tool holding means comprising a holder having an elongated tool slot for receiving a base of a tool, having an adjacent elongated locking slot housing a displaceable locking tool bar which is displaceable between a retracted position to release a tool, and an extended position to lock a tool in the tool slot, and tool pin means for pinning a tool in the tool slot;

(d) a tool assembly mounted on the tool holding means comprising a plurality of tool segments having lateral alignment formations for maintaining adjacent tool segments in alignment;

(e) die holding means positioned in operative association with the other of the frame members for holding die means;

(f) a plurality of first hydraulic rams mounted in laterally spaced relationship to be operative between the tool holding means and the associated frame member;

(g) a plurality of second hydraulic rams mounted in laterally spaced relationship to be operative between the die holding means and the associated frame member;

(h) the first hydraulic rams being adapted to be hydraulically connected together during use for hydraulic fluid to distribute a load applied to a workpiece during use evenly between the first hydraulic rams and provide compensation for frame member deflection during use;

(i) the second hydraulic rams being adapted to be hydraulically connected together during use for hydraulic fluid to distribute a load applied to a workpiece during use evenly between the second hydraulic rams and provide compensation for frame member deflection during use; and 16. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) a die assembly mounted on the die holding means;

(j) the die assembly comprising at least one die block segment including a die bottom;

(k) the die bottom being adjustable in height through displaceable camming means; and (l) the camming means comprising an elongated round bar which is pivotably mounted within the die holding means, the round bar having bearing sections to pivotably support the bar, and lift sections to comprise cam means.

17. A bending press, comprising:

(a) a fixed lower frame member;

(b) a fixed upper frame member mounted above the lower frame member;

(c) tool holding means positioned in operative association with one of the frame members for holding bending tool means;

(d) die holding means positioned in operative association with the other of the frame members for holding die means;

(e) a plurality of first hydraulic rams mounted in laterally spaced relationship to be operative between the tool holding means and the associated frame member;

(f) a plurality of second hydraulic rams mounted in laterally spaced relationship to be operative between the die holding means and the associated frame member;

(g) the first hydraulic rams being adapted to be hydraulically connected together during use for hydraulic fluid to distribute a load applied to a workpiece during use evenly between the first hydraulic rams and provide compensation for frame member deflection during use;

(h) the second hydraulic rams being adapted to be hydraulically connected together during use for hydraulic fluid to distribute a load applied to a workpiece during use evenly between the second hydraulic rams and provide compensation for frame member deflection during use; and (i) a die assembly mounted on the die holding means;

(j) the die assembly comprising at least one die block segment including a die bottom;

(k) the die bottom comprising a split die bottom having tapered walls defining the split to provide for work piece centering during use;

(l) the die bottom being adjustable in height through displaceable camming means; and (m) the camming means comprising an elongated round bar which is pivotably mounted within the die holding means, the round bar having bearing sections to pivotably support the bar, and lift sections to comprise cam means.

* * * * *

UNITED STATES PATENT AND TRADEMARK OFFICE

CERTIFICATE OF CORRECTION

PATENT NO. : 5,067,340

DATED : November 26, 1991

INVENTOR(S) : Donald C. MacGregor

It is certified that error appears in the above-indentified patent and that said Letters Patent is hereby corrected as shown below:

Col. 1, line 6, please delete "988", and substitute therefor --1998--.
Col. 1, line 11, please delete "wor)qpieces", an dsubstitute therefor --workpieces--.
Col. 12, line 34, please delete "1o6", and substitute therefor --106--.
Col. 14, line 23, please delete "!4", and substitute therefor --14--.
Col. 14, line 34, please delete "which", and substitute therefor --which--.

Claim 2, col. 17, line 19, please delete "rsepectively", and substitute therefor --respectively--.
Claim 7, col. 18, line 63, please delete "and".
Claim 7, col. 18, line 67, please delete "disspacable" and substitute therefor --displaceable--.
Claim 8, col. 19, line 46, please delete "dye" and substitute therefor --die--.
Claim 8, col. 19, line 47, please delete "canning" and substitute therefor --camming--.
Claim 8, col. 19, line 48, please delete "canning" and substitute therefor --camming--.
Claim 8, col. 19, line 49, please delete "withint he dye" and substitute therefor --within the die--.
Claim 9, col. 19, line 54, please delete "fixed".
Claim 9, col. 19, line 55, please delete "fixed".
Claim 9, col. 19, line 55, please delete "a", and substitute therefor --an--.
Claim 9, col. 20, line 14, please delete "and".
Claim 13, col. 20, line 52, please delete "first".
Claim 13, col. 20, lines 56-59, please delete "(f) a plurality of second hydraulic rams mounted in laterally spaced relationship to be operative between the die holding means and the associated frome member;".

UNITED STATES PATENT AND TRADEMARK OFFICE

CERTIFICATE OF CORRECTION

PATENT NO. : 5,067,340

DATED : November 26, 1991

INVENTOR(S) : Donald C. MacGregor

It is certified that error appears in the above-indentified patent and that said Letters Patent is hereby corrected as shown below:

Claim 14, col. 21, line 8, please delete "fixed".
Claim 14, col. 21, line 9, please delete "fixed".
Claim 14, col. 21, line 9, please delete "a", and substitute therefor --an--.
Claim 14, col. 21, line 38, please delete "mounte din", and substitute therefor --mounted in--.
Claim 15, col. 21, line 47, please delete "fixed".
Claim 15, col. 21, line 48, please delete "fixed".
Claim 15, col. 21, line 48, please delete "a", and substitute therefor --an--.
Claim 15, col. 22, line 12, after word "use", please insert --and--.
Claim 15, col. 22, line 18, please delete "and".
Claim 15, col. 22, line 18, please delete ";" and substitute therefor --.--.
Claim 16, col. 22, line 20, please delete "fixed".
Claim 16, col. 22, line 21, please delete "fixed".
Claim 16, col. 22, line 21, please delete "a", and substitute therefor --an--.
Claim 16, col. 22, line 48, please delete "and".
Claim 17, col. 22, line 60, please delete "fixed".
Claim 17, col. 22, line 61, please delete "fixed".
Claim 17, col. 22, line 61, please delete "a", and substitute therefor --an--.

UNITED STATES PATENT AND TRADEMARK OFFICE

CERTIFICATE OF CORRECTION

PATENT NO. : 5,067,340

DATED : November 26, 1991

INVENTOR(S) : Donald C. MacGregor

It is certified that error appears in the above-indentified patent and that said Letters Patent is hereby corrected as shown below:

Claim 17, col. 24, line 3, please delete "and".

This certificate supersedes the Certificate of Correction issued on June 22, 1993.

Signed and Sealed this

Twenty-sixth Day of April, 1994

*Attest:*

*Attesting Officer*

Bruce Lehman

BRUCE LEHMAN

*Commissioner of Patents and Trademarks*